US008506047B2

(12) United States Patent
Wachter et al.

(10) Patent No.: US 8,506,047 B2
(45) Date of Patent: Aug. 13, 2013

(54) DEVICE FOR POSITIONING AT LEAST ONE PRINT BAR IN A PRINTING POSITION IN AN INKJET PRINTING APPARATUS

(75) Inventors: Sebastian Wachter, Munich (DE); Augustinus Achatz, Ebersberg (DE)

(73) Assignee: Océ Printing Systems GmbH, Poing (DE)

( * ) Notice: Subject to any disclaimer, the term of this patent is extended or adjusted under 35 U.S.C. 154(b) by 104 days.

(21) Appl. No.: 13/291,529

(22) Filed: Nov. 8, 2011

(65) Prior Publication Data

US 2012/0113190 A1 May 10, 2012

(30) Foreign Application Priority Data

Nov. 8, 2010 (DE) ..... 10 2010 060 405

(51) Int. Cl.
*B41J 2/155* (2006.01)

(52) U.S. Cl.
USPC ..... 347/42; 347/49

(58) Field of Classification Search
USPC ..... 347/13, 42, 49, 108
See application file for complete search history.

(56) References Cited

U.S. PATENT DOCUMENTS

| | | | | |
|---|---|---|---|---|
| 5,428,375 | A | 6/1995 | Simon et al. | |
| 5,825,392 | A | 10/1998 | Mochizuki | |
| 6,095,701 | A | 8/2000 | Sattler | |
| 6,196,675 | B1 | 3/2001 | Deily et al. | |
| 6,213,580 | B1 | 4/2001 | Segerstrom et al. | |
| 6,224,187 | B1 | 5/2001 | Inten et al. | |
| 6,419,334 | B1 | 7/2002 | Akuzawa et al. | |
| 6,431,674 | B2 | 8/2002 | Suzuki et al. | |
| 6,652,062 | B2 * | 11/2003 | Umeyama et al. | 347/20 |
| 6,805,421 | B2 | 10/2004 | Eck et al. | |
| 7,090,329 | B2 | 8/2006 | Nellen | |
| 7,510,251 | B2 * | 3/2009 | Wanibe et al. | 347/7 |

FOREIGN PATENT DOCUMENTS

| | | | |
|---|---|---|---|
| DE | 693 01 763 | T2 | 3/1996 |
| DE | 197 26 642 | C1 | 9/1998 |
| DE | 100 57 062 | C1 | 5/2002 |
| EP | 0 938 973 | A2 | 9/1999 |
| EP | 0 788 882 | B1 | 7/2002 |

* cited by examiner

*Primary Examiner* — Lamson Nguyen
(74) *Attorney, Agent, or Firm* — Schiff Hardin LLP

(57) ABSTRACT

In a print bar system or method in which at least one print bar is positioned in a printing position, first and second drive and guidance units are provided for the print bar and which each have an adjustable guidance unit and a first coupling unit. The print bar has print bar receptacles with adjustable positioning pins. The guidance units and the print bar receptacles are designed such that upon insertion of the print bar into the drive and guidance units the print bar receptacles rest in a floating bearing on the guidance units and are centered and arrested after displacement of the guidance units in the drive and guidance units such that the print bar is positioned into the printing position in the drive and guidance units and wherein the positioning pins engage in the first coupling units.

12 Claims, 13 Drawing Sheets

DEVICE FOR POSITIONING AT LEAST ONE PRINT BAR IN A PRINTING POSITION IN AN INKJET PRINTING APPARATUS

BACKGROUND

Inkjet printing apparatuses are used for single- or multicolor printing of a printing substrate, for example of a single sheet or a belt-shaped recording material made of the most varied materials (paper, for example). The design of such inkjet printing apparatuses is known—see for example EP 0 788 882 B1. Inkjet printing apparatuses that operate according to the drop-on-demand (DoD) principle, for example, have as a printing unit a print head or multiple print heads with nozzles comprising ink channels (whose activators, controlled by a print controller, excite ink droplets in the direction of the printing substrate). These nozzles are directed towards the printing substrate in order to apply print dots for a print image there. The activators can generate ink droplets thermally (bubble jet) or piezoelectrically.

DE 197 26 642 C1 describes a device for positioning an inkjet print head and a cleaning and sealing device. The inkjet print head can be pivoted from a printing position into a cleaning position and back again. A cleaning and sealing device can be displaced onto the inkjet print head and away from the head again. The cleaning and sealing device has a sealing cap and a wiping lip.

In an inkjet printing system, the print heads of one color are mechanically attached on a print bar. In the printing operation, different spacings of the nozzles of the print heads relative to the printing substrate are necessary for cleaning and maintenance. For this the print bar (and therefore the print heads) must be able to be moved in the vertical direction to different positions at different distances from the printing substrate. It must be possible to set two of these positions:

The printing position: positioning of the print heads parallel to the printing substrate; for this the print bar must be able to be adjusted to a height, tilted or set at an angle relative to the printing substrate, and translationally transverse to the travel direction of the printing substrate.

Cleaning position: position for cleaning the nozzles of the print heads. For example, in the cleaning ink is pushed or sucked through the nozzles of the print heads via overpressure or negative pressure. This ink is then subsequently stripped with a rubber lip or multiple rubber lips (called wiping). For this the print bar can be driven over the rubber lips or the rubber lips can be driven over the print bar. An exact positioning of the print bar relative to the rubber lips is necessary in order to ensure a constant overlap between the rubber lips and the nozzles.

From U.S. Pat. No. 6,095,701 it is known to bear a print head in a print head receptacle so that it can be adjusted in three directions. It is thereby possible to adjust the print head at the installation site.

U.S. Pat. No. 7,090,329 B2 describes a printing unit in which the print heads are arranged on rods. The print heads can be displaced on the rods; in addition to this the rods can be rotated with the print heads.

DE 100 57 062 C1 describes a method according to which print heads can be aligned relative to a print good. In addition to this, the print heads can be moved relative to one another, transverse to the printing direction. The print image can hereby be adjusted transverse to the printing direction.

DE 693 01 763 T2 discloses an inkjet printing apparatus in which the print heads are arranged on sliding means so that the print heads can be moved parallel and perpendicular to the direction of the print medium. The print heads can thereby be arranged offset from one another or with the ends at one another.

SUMMARY

It is an object to specify a device for positioning print bars having print heads in an inkjet printing group, in which device the print bars can be positioned exactly in a printing position.

In a print bar system or method in which at least one print bar is positioned in a printing position, first and second drive and guidance units are provided for the print bar and which each have an adjustable guidance unit and a first coupling unit. The print bar has print bar receptacles with adjustable positioning pins. The guidance units and the print bar receptacles are designed such that upon insertion of the print bar into the drive and guidance units the print bar receptacles rest in a floating bearing on the guidance units and are centered and arrested after displacement of the guidance units in the drive and guidance units such that the print bar is positioned into the printing position and wherein the positioning pins engage in the first coupling units.

DESCRIPTION OF THE PREFERRED EMBODIMENT

Figure 1:
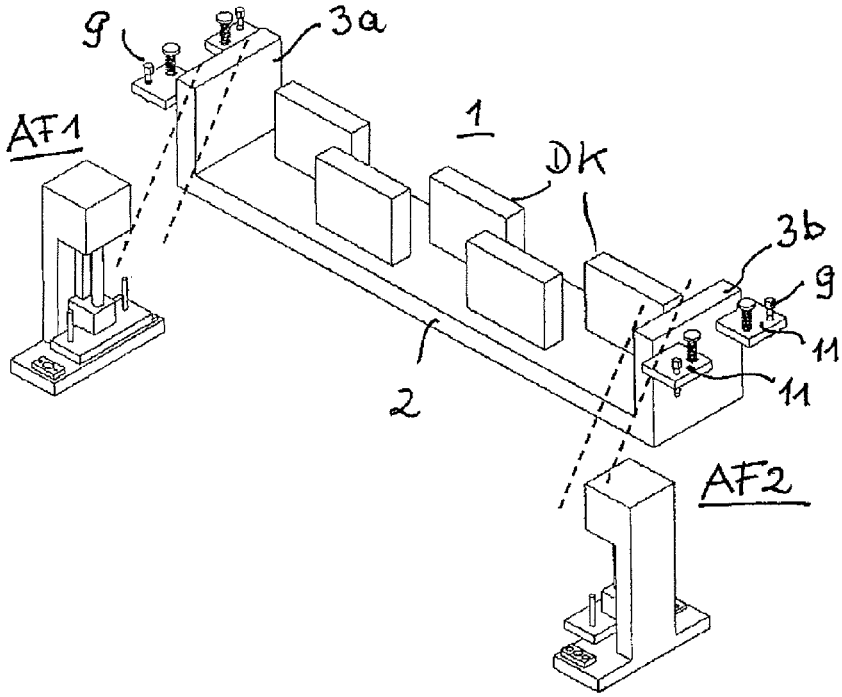
FIG. 1 is a representation of a printing unit with print bar and drive and guidance units before the installation of the print bar in the drive and guidance units.

For the purposes of promoting an understanding of the principles of the invention, reference will now be made to the preferred exemplary embodiment/best mode illustrated in the drawings and specific language will be used to describe the same. It will nevertheless be understood that no limitation of the scope of the invention is thereby intended, and such alterations and further modifications in the illustrated embodiment and such further applications of the principles of the invention as illustrated as would normally occur to one skilled in the art to which the invention relates are included.

In the inkjet printing apparatus according to a preferred exemplary embodiment, at least one print bar having print heads can be positioned exactly in the printing position. In order to be able to adjust the printing position, a device with two drive and guidance units is provided with which the print bar can be coupled. Given use of a print bar, the print bar is coupled with the two drive and guidance units. The print bar is initially imprecisely positioned in an intermediate position and is thereby borne floating in the respective drive and guidance units (position accuracy +/−50 μm in the movement direction). The precise positioning in the printing position is then realized via adjustable stopper pairs in which the print bar centers itself (position accuracy +/−5 μm in all directions). For this the print bar is pressed into the printing position by elastic force and its own weight. Positioning plates in the drive and guidance units and positioning pins at the print bars can be used as stopper pairs. It is likewise possible that the positioning plates are arranged at the print bars and the positioning pins are arranged in the drive and guidance units.

The device according to the preferred exemplary embodiment therefore has the following advantages:

- No expensive, high-precision guidance free of play is required for the print bar.
- A very high precision (+/−5 μm) in the printing position is achieved via stopper pairs.
- The initial setting takes place with a one-time setting procedure of the horizontal print bar position by means of adjustment of at least one positioning plate (fixed bearing). The vertical setting takes place via the adjustment of at least one positioning pin by means of fine threading.
- A realignment of the print bar in the printing position after a print downtime is not necessary. The realignment of the print bar takes place automatically and precisely without manual intervention or monitoring.
- Temperature influences are compensated.
- The positioning device is maintenance-free.

For example, a printing unit can have four print bars with five print heads respectively, wherein each print bar can be operated independently of the other print bars. Each print bar can thus be moved vertically from a printing position into a cleaning position and back, independent of the other print bars. A printing substrate can be printed in the printing position; in the cleaning position the printing unit can be moved as a whole without damaging the print heads and the print heads can be cleaned.

It is an object to specify a device for positioning a print bar with which the movement of the print bar into the printing position can be implemented cost-effectively, but in spite of this a precise bearing of the print bar in the printing position is achieved. The device for positioning the print bar has drive and guidance units that are arranged in a fixed manner in the housing of the printing unit.

The exemplary embodiment is explained using the drawing figures.

Figure 3:
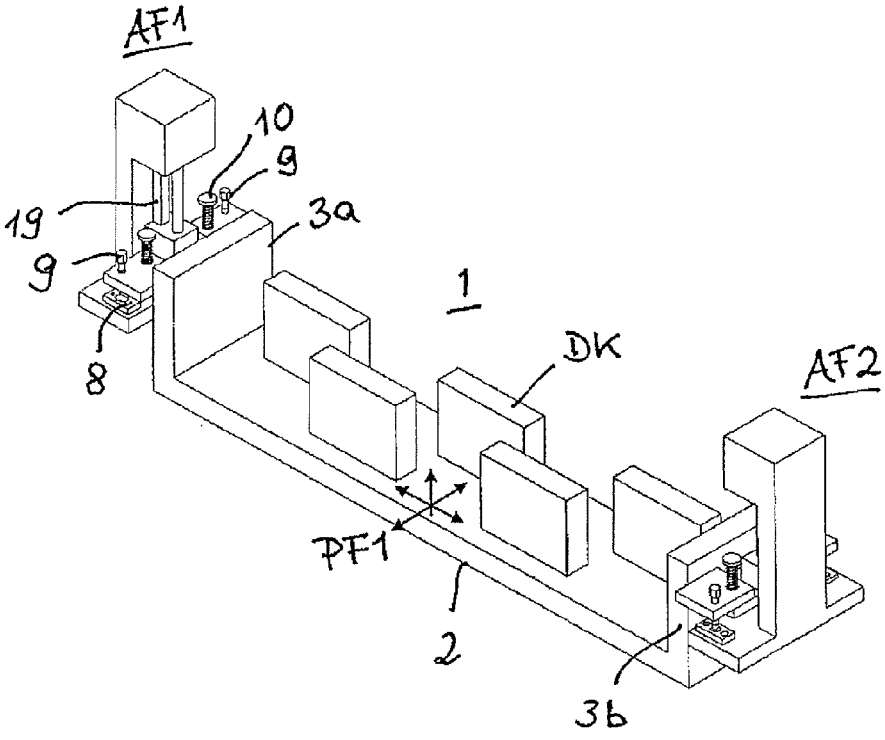
FIG. 3 shows a principle representation of a printing unit with a print bar after installation of the print bar in the drive and guidance units.
Figure 2:
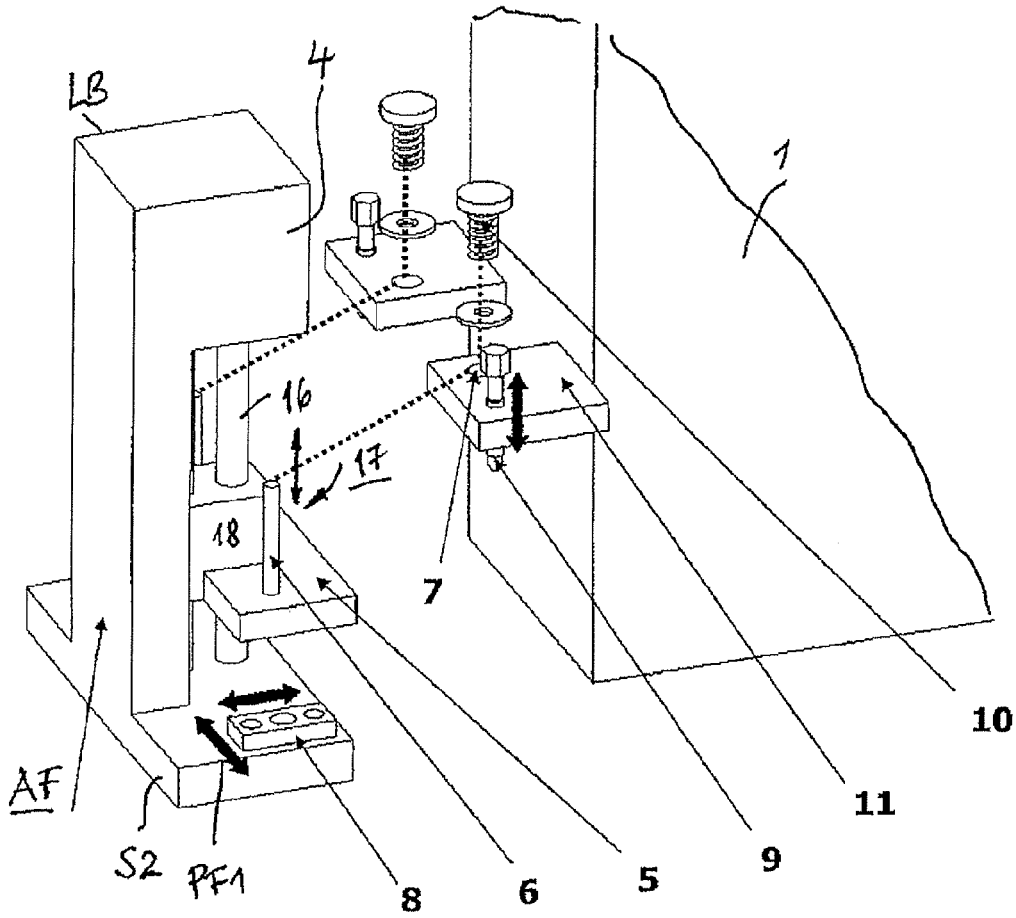
FIG. 2 illustrates a principle representation of a drive and guidance unit with coupling units at the print bar, in an exploded view.

FIG. 1 shows the device before the positioning of the print bar 1 in the drive and guidance units AF1, AF2. FIG. 2 shows the design of a drive and guidance unit AF with the coupling unit of the print bar 1 at the coupling unit of the drive and guidance units AF. FIG. 3 shows the interaction of print bars 1 and drive and guidance units AF1, AF2 after insertion of the print bar 1 into its drive and guidance units AF1, AF2.

According to FIG. 1, the print bar 1 has a print head receptacle 2 for the print heads DK. The print head receptacle 2 ends at both sides in lateral surfaces 3a, 3 that provide respective coupling units 9, 11 for the drive and guidance units AF1, AF2.

According to FIG. 3, each print bar 1 is respectively borne in a drive and guidance unit AF at its two lateral surfaces 3*a*, 3*b;* for example, the print bar 1 is borne at its left lateral surface 3*a* in the drive and guidance unit AF1 and at its right lateral surface 3*b* in the drive and guidance unit AF2. The drive and guidance units AF1 and AF2 are designed identically; however, they can be controlled differently.

FIG. 2 shows an exploded view of a drive and guidance unit AF together with a portion of the print bar 1. The drive and guidance unit AF has a bearing block LB formed in a U-shape, with two legs S1 and S2 between which the drive unit and the guidance unit are borne. For example, the drive unit can provide a step motor and a jack screw 16 driven by the step motor 4; the guidance unit provides a guidance sled 17 coupled with the jack screw 16, which guidance sled 17 has a print bar carrier 5 and an arbor 6. The step motor 4 can be arranged in a leg S1 of the bearing block LP; the other leg S2 of the bearing block LB can be attached to the housing of the printing unit or be part of a floor plate 14 (FIG. 10) into which the print bar 1 can be inserted. The jack screw 16 is borne in the legs S1, S2 of the bearing block LB and interacts with a spindle sled 18 connected with the guidance sled 17, which spindle sled 18 comprises a spindle nut. The jack screw 6 runs in the spindle nut so that the spindle nut (and with it the spindle sled 18 and the guidance sled 17) is moved in the extent of the screw jack 16 given rotation of the jack screw 16. For this the spindle sled 18 is directed in a linear guide 19 (FIG. 3). The guidance unit has the guidance sled 17 attached to the spindle sled 18, such that given movement of the spindle sled 18 the guidance sled 17 is also moved as well. The guidance sled 17 provides the print bar carrier 5 that respectively has one arbor 6 per print bar receptacle 11 of the print bar 1. Positioning plates 8 that can be bolted with the floor plate S2 via bolts (not shown) can be arranged on the floor plate S2.

In order to couple the print bar 1 with the drive and guidance units AF, the drive and guidance units AF have a first coupling unit for which the printing unit carrier 5 of the guidance sled 17 and the positioning plates 8 are provided here in particular. At its lateral surfaces 3, the print bar 1 has a second coupling unit made up of print bar receptacles 11 and positioning pins 9. At each lateral surface 3, at least one print bar receptacle 11 is attached at the print bar 1 per print bar carrier 5. Two print bar receptacles 11 are respectively provided per print bar carrier 5 in the drawing figures. The print bar receptacles 11 have receptacle bores 7 for the arbor 6 of the print bar carrier 5 and positioning pins 9 directed into bores, which positioning pins 9 interact with the positioning plates 8 of the drive and guidance unit AF. In addition to this, an elastic unit 10 with which a defined prestress force can be exerted on the respective print bar receptacle 11 is provided per receptacle bore 7 and arbor 6. The positioning pins 9 can have a threading at least in a middle region, such that they can be vertically adjusted and arrested in the print bar receptacle 11 via screwing. The elastic unit 10 can be screwed onto the arbor 6 in the assembled state, wherein the elastic force on the print bar receptacles 11 can be adjusted.

Upon insertion of a print bar 1 in the drive and guidance units AF, the print bar receptacles 11 are placed on the print bar carrier 5 of the guidance sled 17, wherein the arbor 6 of the print bar carrier 5 engages in the receptacle bores 7 of the print bar receptacles 11 (dashed lines in FIG. 1). An exact positioning of the print bar 1 is not required in this first positioning step. The print bar 1 rests on the print bar carrier 5 due to its weight. The pressure on the print bar carrier 5 can be further increased if an additional pressure is exerted on the print bar carrier 5 via the elastic unit 10. If the receptacle bores 7 have a greater diameter than the arbor 6, the print bar 1 remains movable on the guidance sled 17 in a horizontal plane (floating bearing). If the elastic units 10 are screwed onto the arbor 6, a defined prestress force can be exerted on the print bar carrier 5 (and therefore on the guidance sled 17) that prevents a raising of the print bar 1 without a counter-force. However, the positioning pins 9 still do not rest on the associated positioning plates 8. FIG. 3 shows this case: here the print bar 1 has been inserted into its drive and guidance units AF but an arresting of the print bar in the drive and guidance units AF has not yet taken place.

The print bar 1 can thus be moved in the horizontal direction due to its floating bearing (arrow PF1 in FIG. 3); a mobility counter to the elastic force of the elastic unit 10 exists in the vertical direction. For example, the possible movement range of the print bar 1 is chosen at ±2 mm in the horizontal direction and at ±7 mm in the vertical direction.

The arresting of the print bar 1 in the drive and guidance units AF takes place via the positioning pins 9 that strike the associated positioning plates 8 upon lowering of the print bar 1, wherein the positioning plates 8 serve as stoppers. The unit made up of a positioning pin 9 and a positioning plate 8 is also called a stopper pair in the following.

Figure 13:
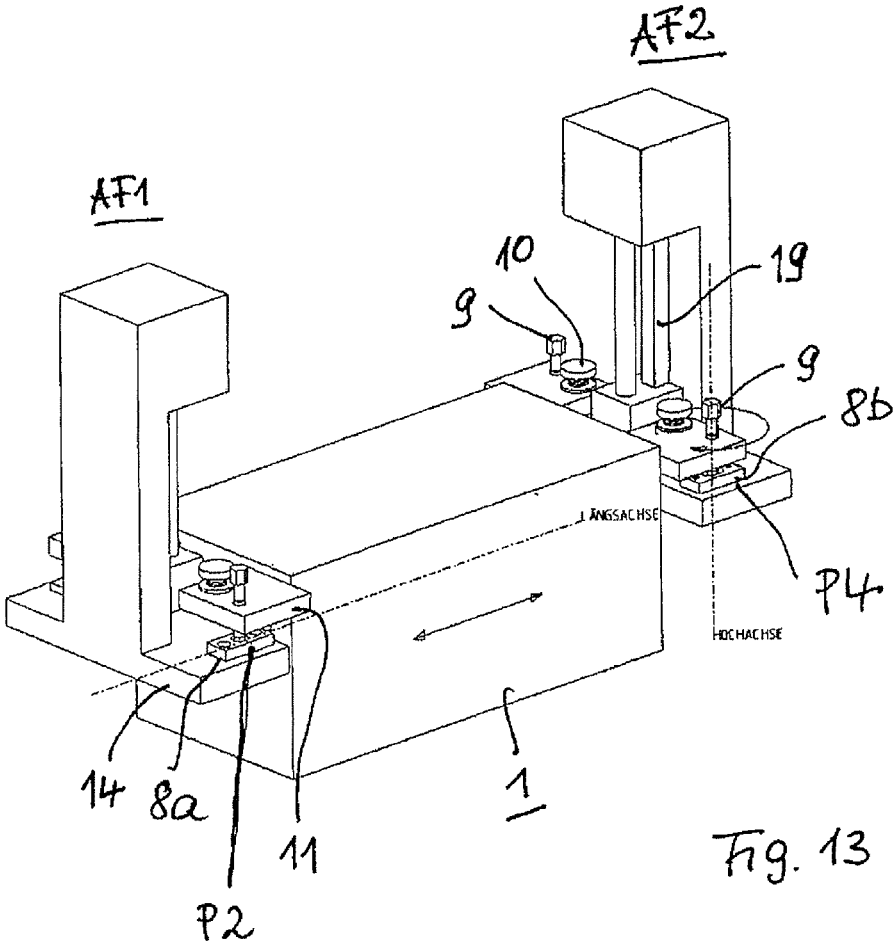
FIG. 13 shows the print bar with the drive and guidance units in the printing position.
Figure 17:
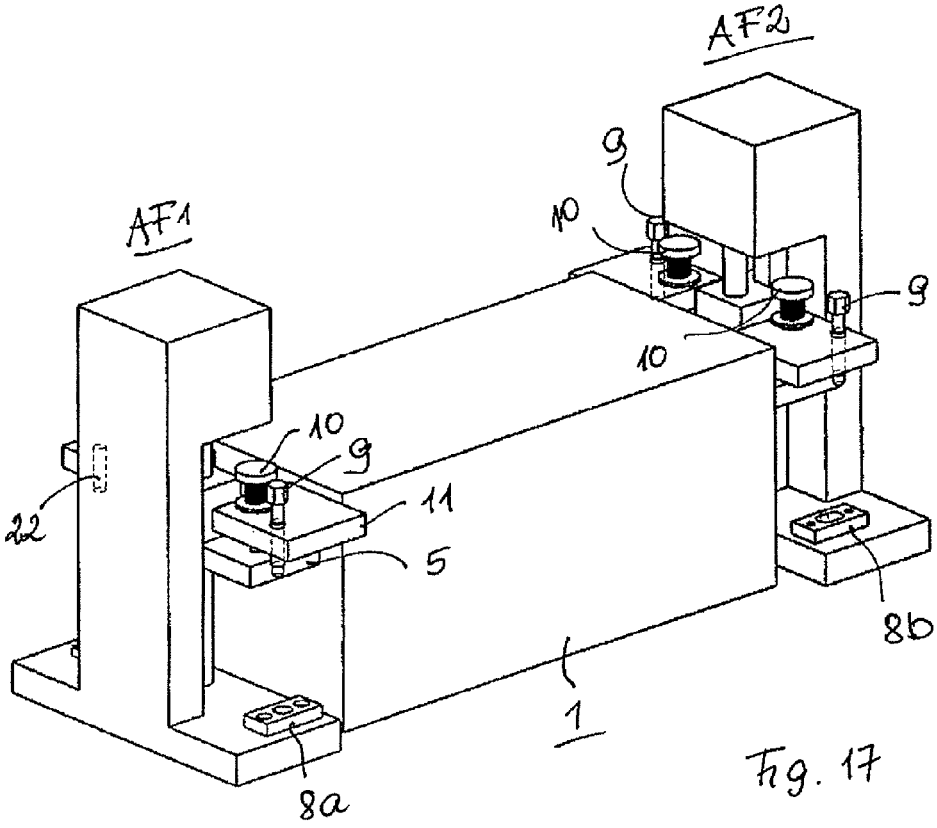
FIG. 17 shows the cleaning position of the print bar.

Upon insertion of the print bar 1 into the drive and guidance units AF, two positioning steps are thus executed:

- The first positioning step leads to an intermediate position (FIG. 3) in which the print bar 1 is borne floating in its drive and guidance units AF1, AF2; the position of the print bar 1 can therefore still be corrected.
- In the second positioning step the print bar 1 reaches its printing position as an end position (for example as shown in FIG. 13). In this end position the print bar 1 is exactly centered and arrested in its drive and guidance units AF1, AF2; for this the positioning plates 8 and the positioning pins 9 are provided as stopper pairs. Two stopper pairs 8, 9 are respectively used per drive and guidance unit AF, wherein a stopper pair 8, 9 is respectively arranged at both sides of the print bar carrier 5.
- Furthermore, the print bar 1 can also be brought in the opposite direction, for example into a cleaning position (FIG. 17).

In order to achieve an exact arresting of the print bar 1 in the drive and guidance units AF in the second positioning step, two positioning plates 8 (for example) can respectively be provided in each drive and guidance unit AF, which positioning plates 8 respectively interact with positioning pins 9 of the print bar receptacles 11. In the exemplary embodiment four stopper pairs 8, 9 made up of a respective positioning pin 9 and a positioning plate 8 are therefore provided, wherein a stopper pair 8, 9 is arranged on both sides of the print bar carrier 5, and wherein the four print bar receptacles 11 of the print bar 1 (and therefore the print bar 1) can be brought into a defined, fixed position in all planes parallel to the printing substrate. The positioning pins 9 of the stopper pairs 8, 9 can be identical in execution; however, the positioning plates 8 are of different designs.

In the printing position, the print bar 1 is positioned—mechanically decoupled due to the floating bearing—in the positioning plates 8 in an accurately repeatable manner. Due to the adjustment range of the print bar 1 because of the floating bearing and because of an adjustable execution of the stopper pairs 8, 9, the print bar 1 can be brought into a defined, fixed position in all directions in comparison to the printing substrate (FIG. 3; arrow PF1).

Figure 4:
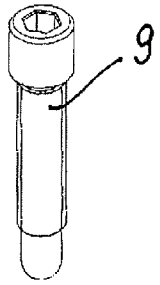
FIG. 4 is a representation of a positioning pin.

FIG. 4 shows one embodiment of a positioning pin 9. The positioning pins 9 can have a threading (not shown) in a middle region in order to be able to be adjusted via screwing in the associated print unit receptacle 11. The tip of the positioning pin 9 can be rounded in order to facilitate a coupling with the associated positioning plate 8 upon lowering the print bar 1.

Figure 5A:
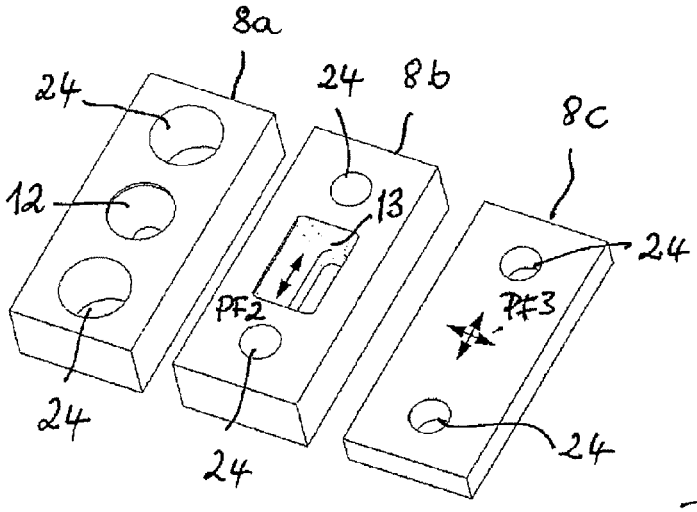
FIG. 5*a*, 5*b* illustrate realizations of positioning plates.

FIG. 5 shows realizations of positioning plates 8. The positioning plates 8 can be bolted to the floor plate S2 (floor plate 14 in FIG. 10) of the drive and guidance units AF; two bores 24 through which bolts (for example) can be directed are respectively provided for this, for example. In contrast to this, the positioning plates 8 are designed differently with regard to the interaction with the positioning pins 9:

- the positioning plate 8*a* has a conical depression 12 that, for example, can lead into a bore 25;
- the positioning plate 8*b* provides a prismatic depression 13 that, for example, can lead into a wedge-shaped breakthrough 26;
- the positioning plate 8*c* is executed flat on its surface.

Given interaction with the positioning pins 9, the positioning plate 8*a* enables a fixed bearing (0 degrees of freedom), the positioning plate 8*b* enables a floating bearing with one degree of freedom (arrow PF2), and the positioning plate 8*c* enables a floating bearing with two degrees of freedom (arrow PF3).

Figure 5B:
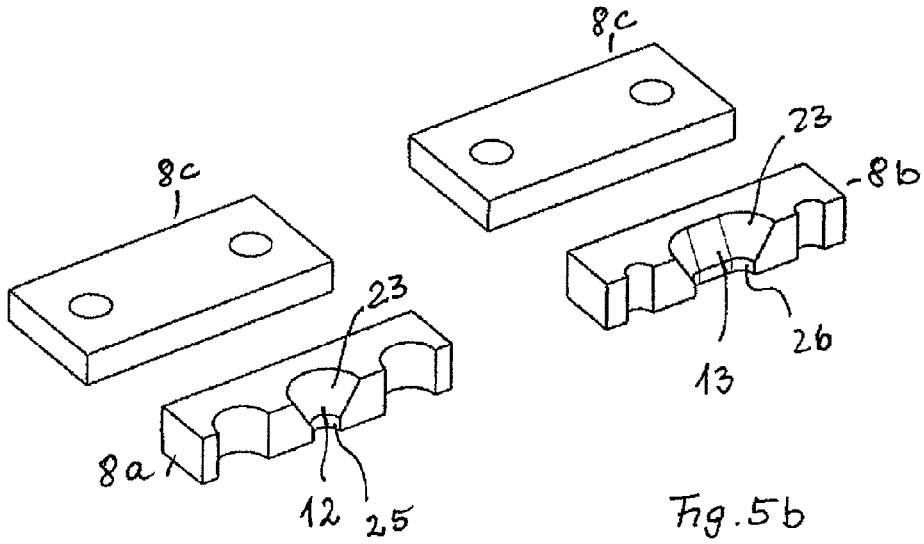
Figure 6:
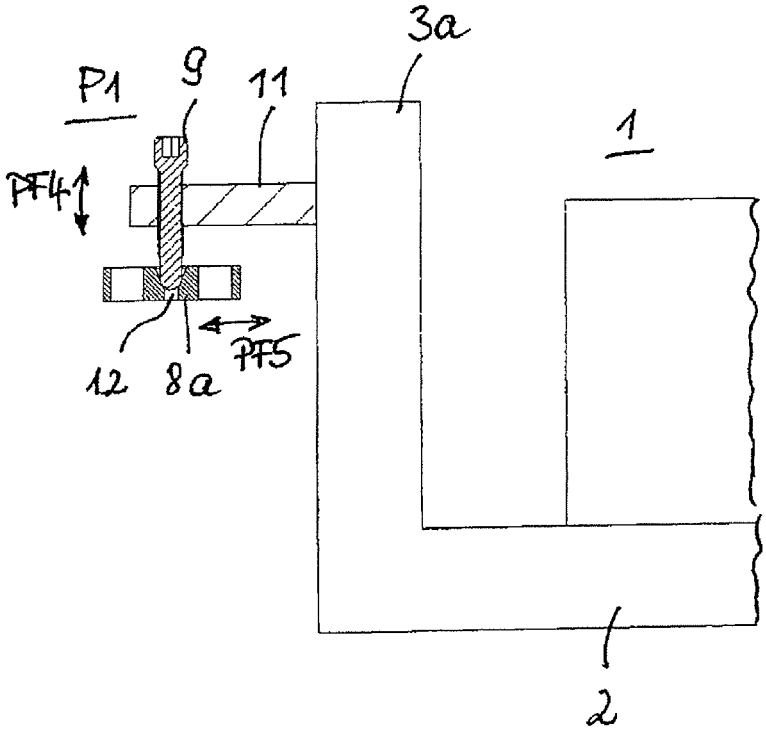
FIG. 6 is a representation of a stopper pair made up of positioning pin and positioning plate given their coupling.

FIG. 5*b* shows the positioning plates 8 in an enlarged presentation, wherein the positioning plates 8*a* and 8*b* are shown in section:

- The positioning plates 8*c* are realized as flat plates; they allow displacements of the positioning pin 9 in the horizontal direction; they thus have two degrees of freedom.
- The positioning plate 8*a* has the conical depression 12 for the associated positioning pin 9; it therefore does not allow any displacement of the positioning pin 9, thus has no degrees of freedom and serves as a fixed bearing. In order to facilitate a sinking of the positioning pin 9 into the positioning plate 8*a*, the depression 12 is realized as a conical depression with angled side walls 23.
- the positioning plate 8*b* has an oblong hole 13 and allows a displacement of the positioning pin 9 in one direction (=one degree of freedom). Here a prismatic depression with angled side surfaces 23 is provided in order to facilitate a sinking of the positioning pin 9 into the positioning plate 8*b*.
- The arrangement of the different positioning plates 8*a* through 8*c* on the floor plate 14 can be learned from FIG. 6*b* and is explained in FIG. 10.

If the print bar 1 is located in the printing position, all positioning pins 9 have contact with the associated positioning plates 8. The functionality of a stopper pair 8, 9 given use of the positioning plate 8*a* results from FIG. 6. In the lowering process of the print bar 1 into the printing position, the positioning pin 9 sinks into the conical depression 12 of the positioning plate 8*a* and aligns in the depression 12 up to the stop due to the weight of the print bar 1 and the additionally applied elastic prestress via the elastic unit 10. For example, the elastic tension is generated when the guidance sled 17 is lowered by 7 mm in the vertical direction, for example. The position of the print bar 1 is defined in a fixed manner in all directions at this positioning point P1 and can be influenced according to the following with two adjustment capabilities:

in the horizontal direction via adjustment of the positioning plate 8*a* (arrow PF5);

in the vertical direction via adjustment of the positioning pin 9 via screwing in the print bar receptacle 11 (arrow PF4).

Figure 7:
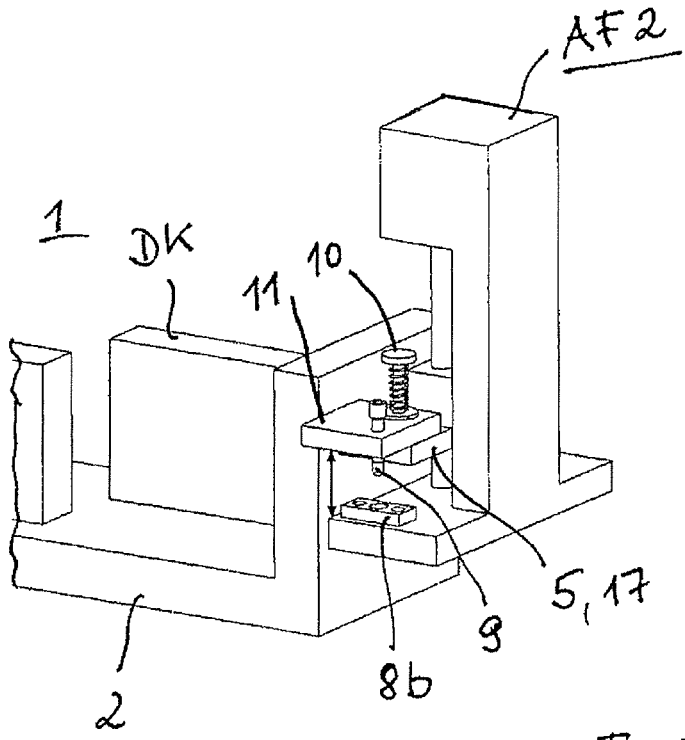
FIG. 7 shows the beginning of the positioning process given a floating bearing of the print bar.
Figure 8:
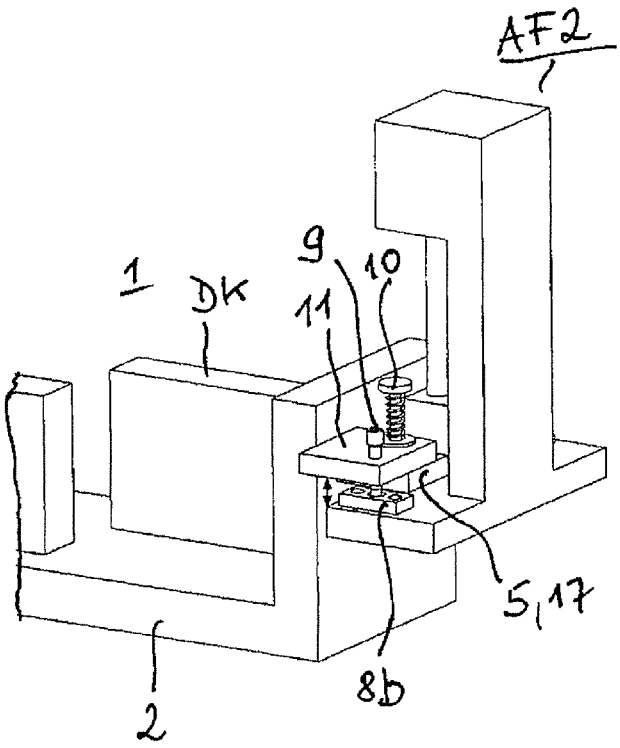
FIG. 8 illustrates the beginning of the engagement of the positioning pin in the positioning plate.
Figure 9:
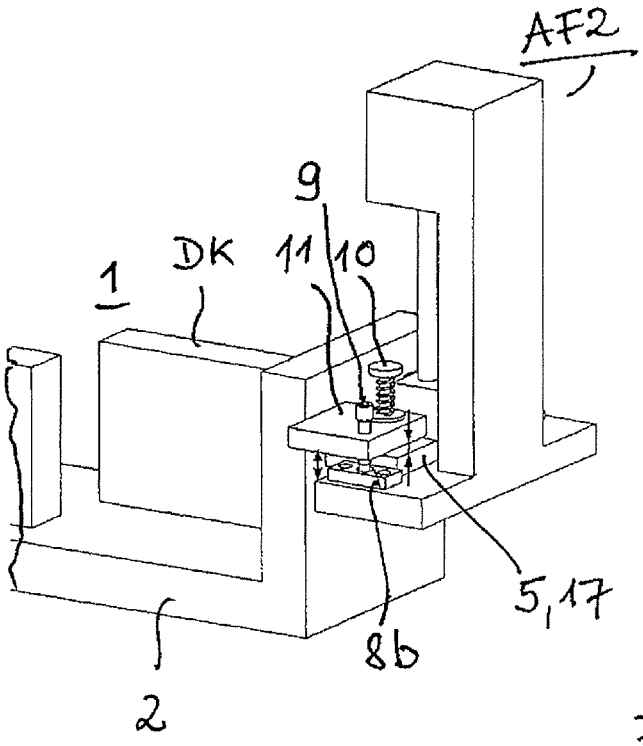
FIG. 9 shows the ultimate positioning of the positioning pin in the positioning plate.

FIG. 7 through 9 show in detail the workflow of the positioning process given use of a positioning plate 8*b*. In FIG. 7 the print bar 1 is located at an undefined vertical position. The print bar 1 rests on the print bar carrier 5 of the guidance sled 17 of the drive and guidance unit AF2 and is additionally pressed onto the print bar coil array 5 with a defined elastic tension of the elastic unit 10. for example, the vertical position of the print bar 1 is determined by the step count of the step motor 4. Due to the floating bearing, the horizontal position of the print bar 1 lies in a movement range of 2 mm, for example (due to the different diameter of arbor 6 and receptacle bore 7). The print bar 1 with the guidance sled 17 is subsequently moved downward until the positioning pin 9 reaches the depression 13 in the positioning plate 8*b* (FIG. 8). Upon entering the depression 13, the print bar 1 aligns in the position predetermined by the horizontal attitude of the positioning plate 8*b* and the vertical attitude of the height-adjusted positioning pin 9. In order to ensure the high precision of the printing position of the print bar 1 with accurate reproducibility, in the next step a prestress can additionally be applied to the stopper pair 8, 9 in that the guidance sled 17 is lowered by an additional 7 mm, for example (FIG. 9). Now the print bar 1 lies in the printing position with its own weight and prestress.

In FIGS. 7 through 9 the positioning plate 8*b* has been inserted as positioning plates 8. The positioning proceeds corresponding to the use of the positioning plate 8*a*. Given use of the positioning plates 8*c*, the positioning pin 9 only strikes the surface of the respective positioning plate 8*c*.

Figure 10:
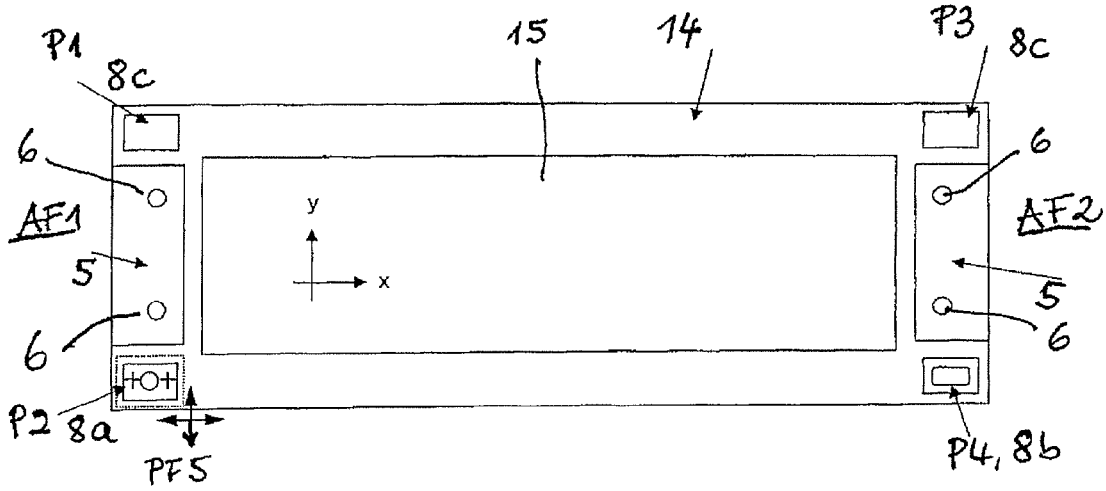
FIG. 10 is a view of the floor plate with drive and guidance units without print bar, from above.

An arrangement of the positioning plates 8 on a floor plate 14 without print bar 1 can be learned from FIG. 10. In particular, the position points P of the positioning plates 8 are shown. The floor plate 14 has a rectangular break-through 15 for the print bar 1. A drive and guidance unit AF1, AF2 (of which only the print bar carrier 5 with the arbors 6 and the positioning plates 8 are shown in the explanation) is respectively arranged at the lateral surfaces of the floor plate 14. The drive and guidance unit AF1 has at the positioning point P1 a positioning plate 8*c* that provides a floating bearing with two degrees of freedom and at the positioning point P2 a positioning plate 8*a* that represents a fixed bearing. The positioning plate 8*a* at the positioning point P2 can additionally be adjusted horizontally in its position on the floor plate 14 (arrow PF5). The drive and guidance unit AF2 has at the positioning point P3 a positioning plate 8*c*, thus a floating bearing with two degrees of freedom, and at the positioning point P4 a positioning plate 8*b*, thus a floating bearing with one degree of freedom. Of the positioning plates 8 only the positioning plate 8*a* is thus arranged so as to be adjustable on the drive and guidance unit AF1; the positioning plates 8*b* and 8*c* are connected (bolted, for example) with the respective floor plate 14 such that they cannot be adjusted.

Figure 11:
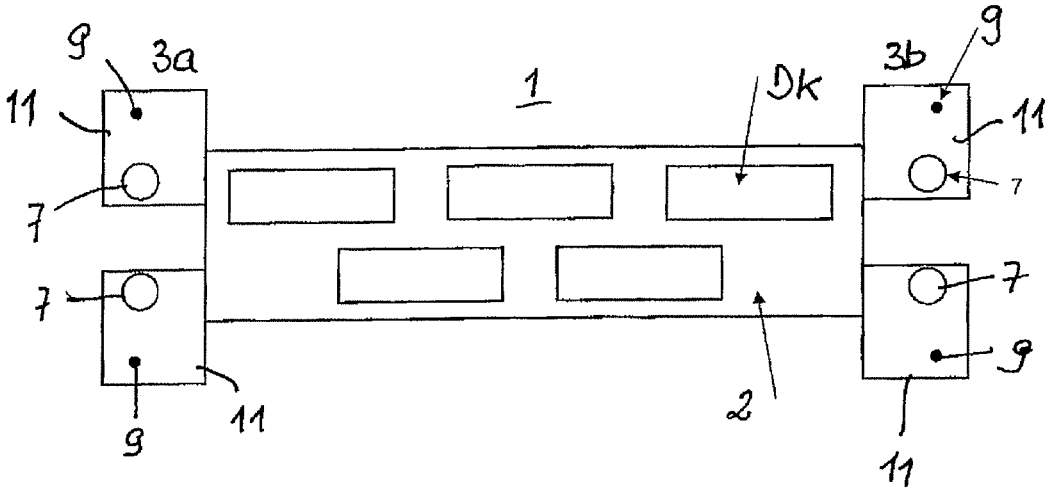
FIG. 11 is a view of the print bar from above.

FIG. 11 shows the print bar 1 from above. Print heads DR on the print head receptacle 2 are on the print bar 1. The lateral surfaces 3*a*, 3*b* have the print bar receptacles 11 with the positioning pins 9 and the receptacle bores 7.

Figure 12:
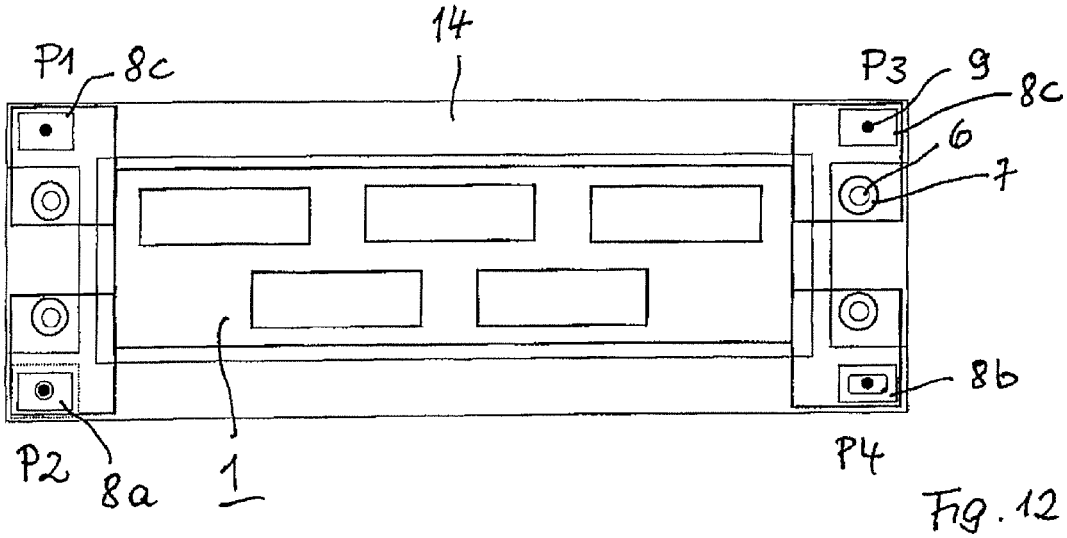
FIG. 12 is a view of the print bar and the floor plate in an assembled state, from above.

An overall view from above of the print bar used in the floor plate 14 results from FIG. 12. Of the drive and guidance units AF, only the print bar carriers 5 with the arbors 6 and positioning plates 8 and, in the print bar 1, the print bar receptacles 11 with the receptacle bores 7 and the positioning pins 9 are shown. It is apparent that the diameter of the receptacle bores 7 is greater than the diameter of the arbor 6.

FIG. 13 shows the print bar 1 in the printing position. Furthermore, it is apparent how the print bar 1 can be adjusted in the drive and guidance units AF before the printing operation. The print bar 1 is shown together with the drive and guidance units AF1, AF2. In order to be able to adjust the print bar 1 in the horizontal direction, the positioning plate 8*a* is arranged at the positioning point P2 such that it can be displaced on the floor plate 14; in addition to this, a fixed positioning plate 8*b* with an oblong depression 13 is provided at the positioning point P4. The positioning pins 9 that are situated at the positioning points P1 and P3 can likewise be displaced in the horizontal direction since positioning plates 8*c* are attached there. In order to be able to adjust the print bar 1 in the vertical direction, the positioning pins 9 can be adjusted in the print bar receptacles 11.

Figure 14A:
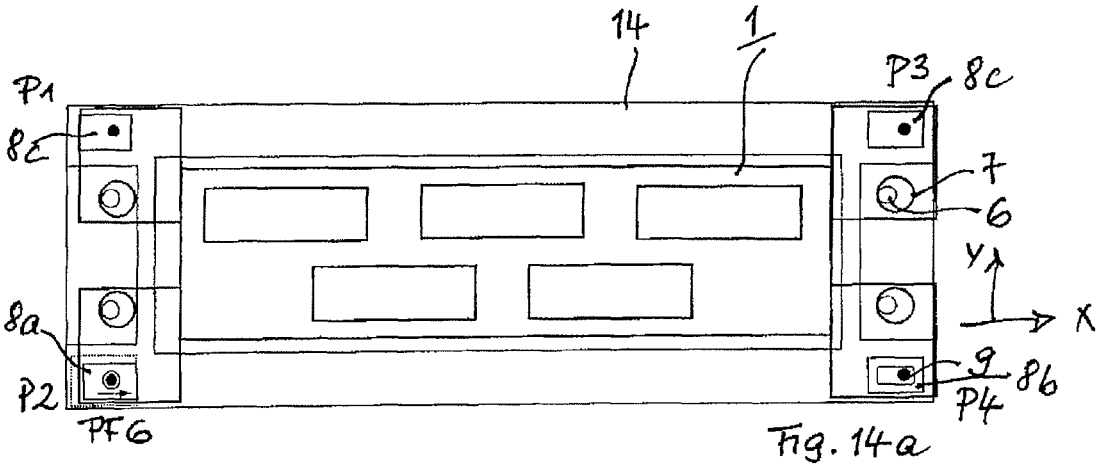
FIGS. 14*a-c*, 15*a, b* and 16*a, b* illustrate possibilities for adjusting the print bar, for example relative to the printing substrate in the horizontal and vertical direction.
Figure 14B:
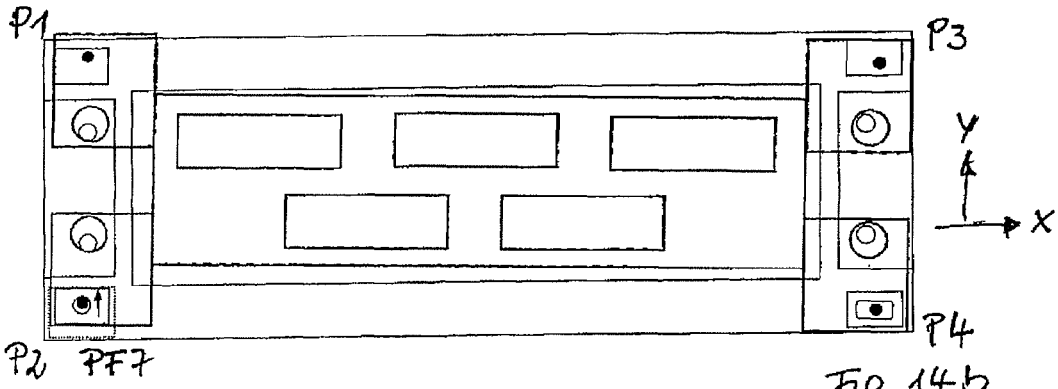
Figure 14C:
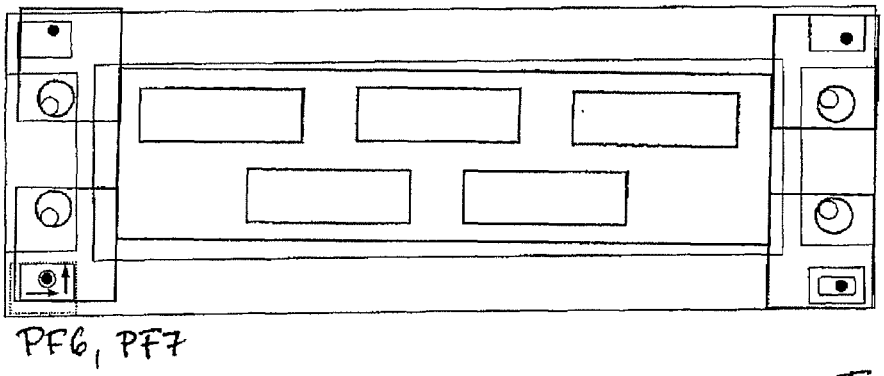

FIG. 14*a*-14*c* show the adjustment possibilities of the print bar 1 in the horizontal direction. The attitude of the print bar 1 after adjustment is thereby shown.

In FIG. 14*a*, the print bar has been displaced in the x-direction, for example transverse to the transport direction of the printing substrate. The positioning plate 8*a* has thereby been shifted (arrow PF6); in addition to this the positioning pins 9 have been displaced into the depression of the positioning plate 8*b*. The positioning pins 9 on the positioning plates 8*c* follow this displacement.

A displacement of the print bar 1 to one side (left side) in the y-direction is shown in FIG. 14*b*. Now the positioning plate 8*a* has been shifted in the y-direction (arrow PF7). The positioning pins 9 at the positioning plates 8*c* follow the displacement; the positioning pin 9 at the positioning point P4 maintains its position.

A displacement of the print bar 1 in the x-direction and in the y-direction can be learned from FIG. 14*c*.

The dimension of the adjustment is limited by the diameter of the receptacle bores 7 and by the diameter of the arbor 6.

Via this embodiment of the positioning plates 8 and their arrangement, all adjustments of the print bar 1 that are required in the horizontal can be made with the displacement of only one positioning plate 8*a*.

An adjustment of the print bar 1 in the vertical direction can take place with the aid of the positioning pins 9 that can be displaced relative to the print bar receptacles 11. For this, each positioning pin 9 (in its middle region, for example) and the print bar receptacles 11 can have a threading so that the positioning pins 9 can be screwed through the print bar receptacles 11. The displacement capabilities in the vertical direction are shown in principle in FIGS. 15 and 16.

Figure 15A:
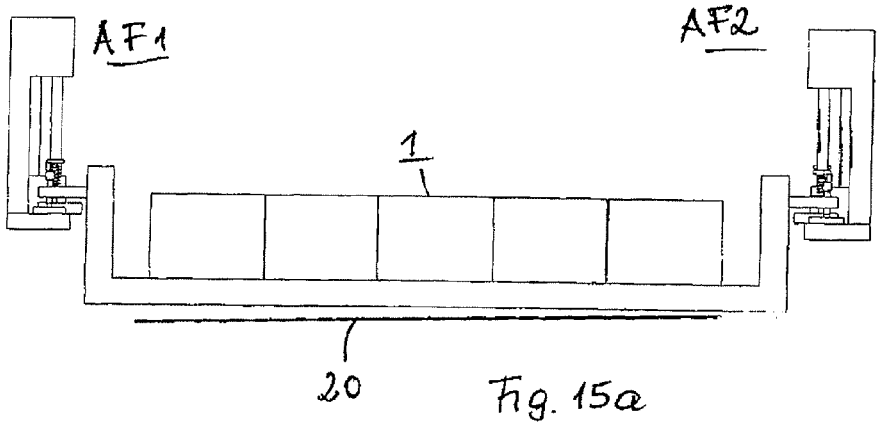
Figure 15B:
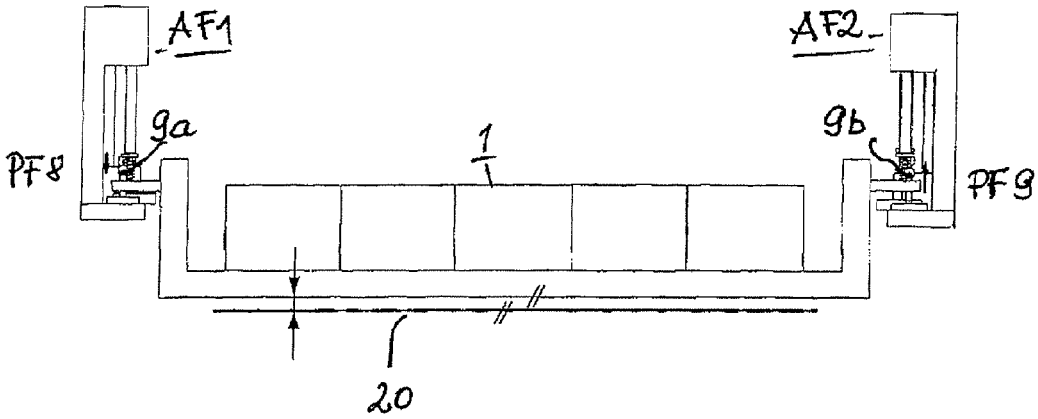

FIG. 15*a* shows the case in which a print bar 1 does not lie parallel to the printing substrate 20. In order to correct this, the positioning pins 9 are displaced in their print bar receptacles 11 (FIG. 15*b*). The positioning pin 9*a* is screwed downward so that the print bar 1 moves upward (arrow PF 8); the positioning pin 9*b* is screwed upward and a downward movement of the print bar 1 takes place (arrow PF 9). A rotation of the print bar 1 around its transverse axis takes place.

Figure 16A:
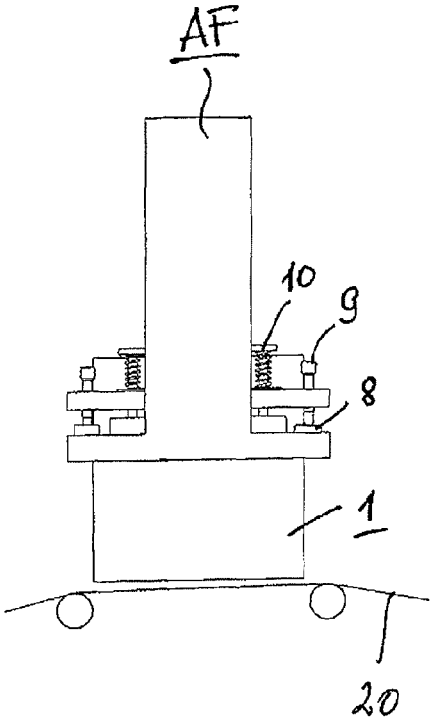
Figure 16B:
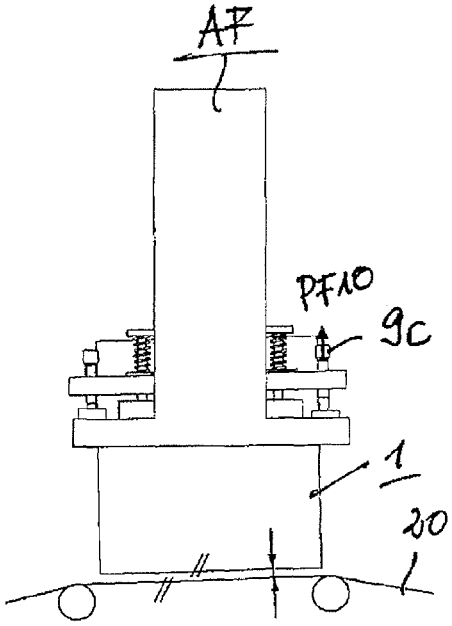

An additional adjustment possibility of the print bar 1 results from FIG. 16. Here the absent parallelism of the print bar 1 relative to the printing substrate 20 (FIG. 16*a*) is corrected in that the print bar 1 is rotated around its longitudinal axis. For this, in the example case of FIG. 16*a* the positioning pin 9*c* is screwed downward in its print bar receptacle 11 and the print bar 1 is therefore raised (FIG. 16*b*; arrow PF 10).

In FIGS. 15 and 16 the arrows PF8 through PF10 indicate the movement direction of the print bar 1.

FIGS. 14 through 16 show how a print bar 1 can be set in the printing position before the beginning of the printing operation. However, a centering of the print bar 1 is likewise necessary in the printing operation since the print bar 1 must always be raised again from the positioning plates 8 during the printing operation. This is necessary in order to be able to take up the different working positions with the print bar 1 in order to be able to clean the print heads DK or in order to be able to cover the print heads with protective caps, for example. These working positions lie above the printing position; a centering of the print bar 1 corresponding to the printing position is not necessary here. If the print bar 1 is again driven into the printing position, the precise adjustment of the print bar 1 relative to the printing substrate 20 must be achieved again.

Figure 18:
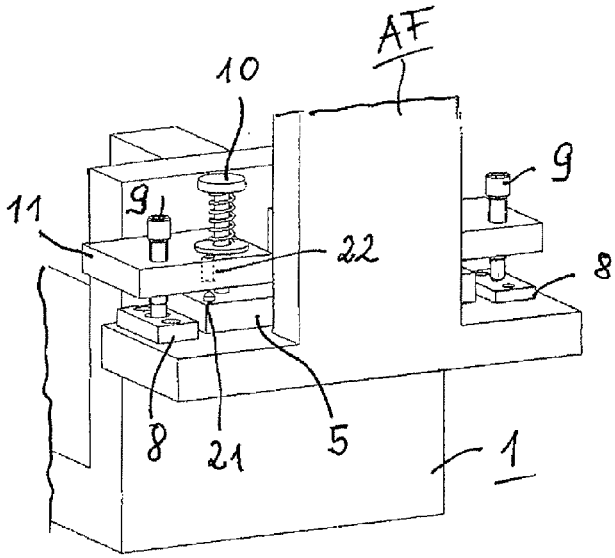
FIG. 18 illustrates one possibility of pre-centering the print bar before reaching the cleaning position.

FIG. 17 shows the starting position of the print bar 1 (for example in the cleaning position). The drive units AF have raised the print bar carrier 5, and with it the print bar receptacles 11 for the print bar 1. The elastic units 10 press the print bar receptacles 11 onto the print bar carrier 5 of the guidance sled 17 and establish an exact position of the print bar 1 in the cleaning position. The positioning pins 9 have released from the associated positioning plates 8. In this position the floating bearing of the print bar 1 is active. Since the floating bearing allows a liberal play, the print bar 1 can execute movements in the horizontal direction. If the maximum play of the floating bearing should be limited, a pre-centering can be introduced that, for example, provides a centering pin 21 on a print bar carrier 5 (FIG. 18) that engages in a counterbore 22 in the print bar receptacle 11 (FIG. 17, 18). The horizontal freedom of movement of the print bar 1 can be established via selection of the diameter of centering pin 21 and counter-bore 22.

Figure 19:
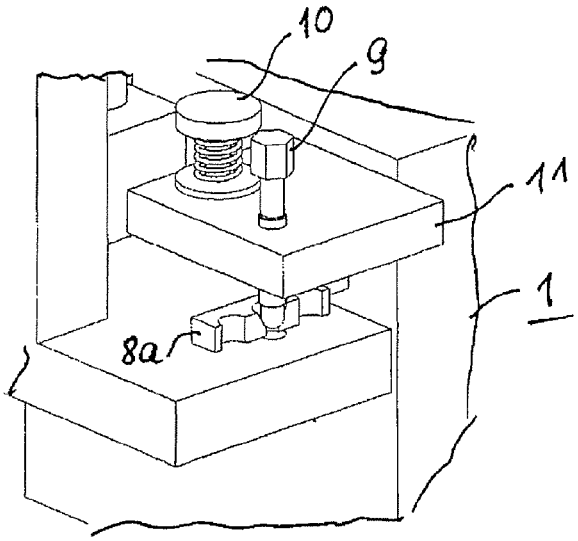
FIG. 19 through 22 show examples for the interaction of the stopper pairs upon a lowering of the print bar into the printing position.
Figure 20:
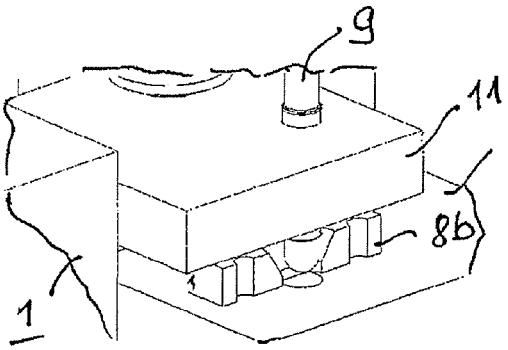

Given movement of the print bar 1, for example into the cleaning position, the print bar 1 can slide opposite the positioning plate 8. However, given lowering of the print bar 1 into the printing position again the positioning pins 9 strike their associated positioning plates 8 again and are thereby repositioned since the maximum play of the floating bearing is less than the diameter of the conical depression 12 of the positioning plate 8*a* or less than the width of the wedge-shaped depression 13 of the positioning plate 8*b* (FIG. 5). Upon lowering the print bar 1, the positioning pins 9 strike the angled surfaces 23 of the depressions 12 or 13 of the positioning plates 8*a* or 8*b* (for example the positioning plate 8*a* in FIG. 19; the positioning plate 8*b* in FIG. 20; these are shown in section). Given the further lowering of the print bar 1, this is then shifted horizontally via the horizontally acting force that is thereby generated. The horizontal force is generated by the weight of the print bar 1 on the angled surfaces 23 of the positioning plates 8*a*, 8*b* (FIG. 19, FIG. 20). The print bar 1 can be lowered until the positioning pins 9 have reached their end positions. Depending on the stopper pair 8, 9, the impact point between positioning pins 9 and positioning plates 8 has a different contact surface:

- stopper pair 9, 8*a* (FIG. 19): line contact (circular) between the fixed bearing 8*a* and the positioning pin 9.
- stopper pair 9, 8*b* (FIG. 20): two point contacts between the fixed positioning plate 8*b* and the positioning pin 9.
- stopper pair 9, 8*c:* point contact between the surfaces of the positioning plates 8*c* and the positioning pins 9.

Figure 21:
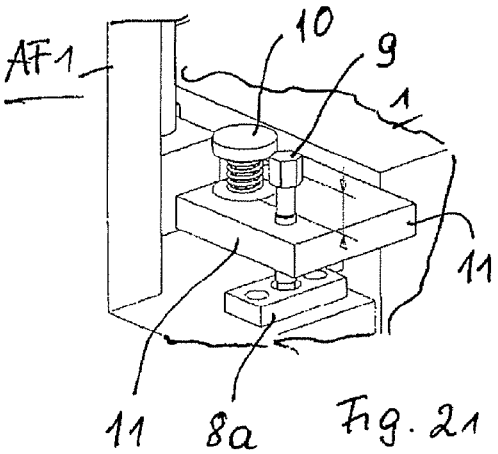
Figure 22:
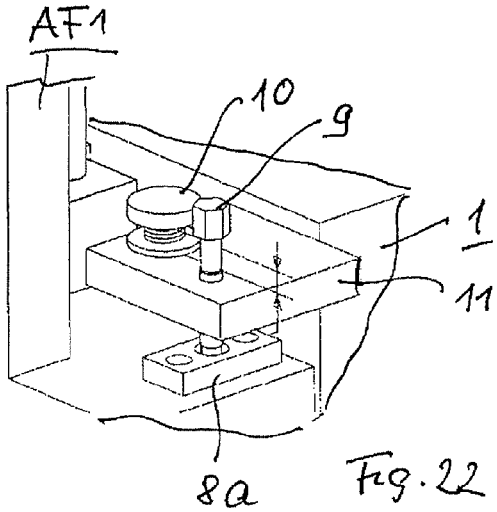

If the print bar 1 is moved further downward, the force of the weight of the print bar 1 is amplified by the elastic force of the elastic units 10 per position point P since the guidance sled 17 is further lowered by the drive unit but the print bar 1 is already located in its end position. FIGS. 21 and 22 show these relationships. The precision of the positioning increases and the sensitivity to vibrations decreases due to the force increase due to this. A high precision in the travel into the printing position is thereby achieved (±5 μm, for example).

The execution and the arrangement of the stopper pairs 8, 9 also has a very advantageous effect given temperature fluctuations. Here irregular length expansions of print bar 1 and floor plate 14 can occur. These different expansions can be contained by the embodiment of the positioning plates 8. If the print bar heats faster than the floor plate 14, for example upon activation of the printer, the print bar 1 can expand in all directions starting from the fixed point (position point P2) of the bearing by the stopper pair 9, 8*a*, without deforming. The print bar 1 therefore expands unchecked because

Figure 23:
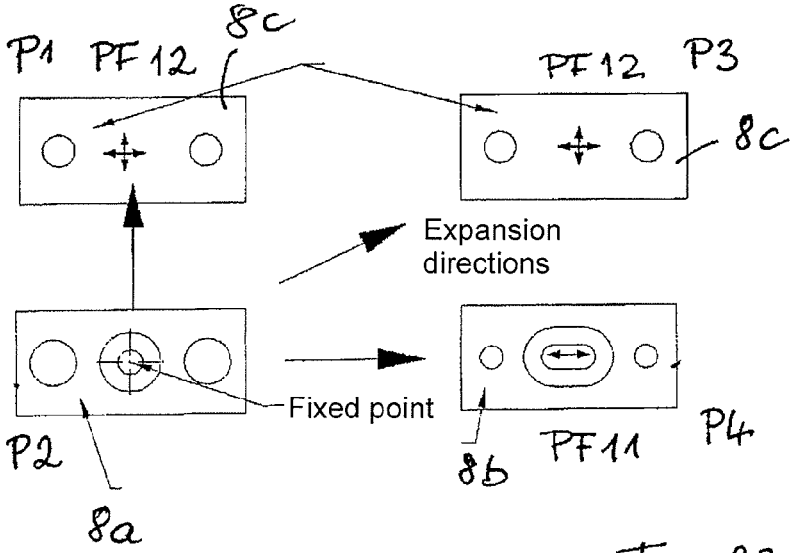
FIG. 23 illustrates a principle representation of the compensation of the influence of temperature at the print bar and at the floor plate.

- the positioning plate 8*b* allows a sliding of the positioning pin 9 in the direction of the oblong hole 13 (FIG. 23; arrow PF 11);
- the positioning plates 8*c* allow a sliding of the positioning pins 9 in the x-direction and y-direction (FIG. 23, arrows PF12).

The vertical adjustment given temperature changes is maintained by the spatial separation of horizontal and vertical adjustment of the print bar 1. The horizontal position of the print bar 1 is provided and set solely via the position of the positioning plates 8*b* and 8*c;* the vertical position of the print bar 1 is provided by rotations of the positioning pins 9 in the print bar receptacles 11 (height adjustment via thread drive).

Four respective stopper pairs have been provided in the exemplary embodiments. However, it is sufficient to use only three stopper pairs; for example, a positioning plate 8*c* with a positioning pin 9 can be omitted.

Although a preferred exemplary embodiment is shown and described in detail in the drawings and in the preceding specification, it should be viewed as purely exemplary and not as limiting the invention. It is noted that only a preferred exemplary embodiment is shown and described, and all variations and modifications that presently or in the future lie within the protective scope of the invention should be protected.

We claim as our invention:

1. A print bar system in which at least one print bar is positioned in a printing position in an inkjet printing apparatus, comprising:

first and second drive and guidance units for the print bar, said drive and guidance units each respectively having an adjustable guidance unit and a first coupling unit;

the print bar having print bar receptacles with adjustable positioning pins for each of the drive and guidance units;

the guidance units of the drive and guidance units and the print bar receptacles of the print bar being designed such that upon insertion of the print bar into the drive and guidance units, the print bar receptacles of the print bar rest in a floating bearing on the guidance units of the drive and guidance units and are centered and arrested after displacement of the guidance units in the drive and guidance units such that the respective print bar is positioned in said printing positions and wherein the positioning pins engage in the first coupling units.

2. The device according to claim 1 wherein at least one positioning plate is arranged to be adjustable in each of the respective drive and guidance units.

3. The device according to claim 1 wherein first and second positioning plates are positioned at a distance from one another in each drive and guidance unit, said positioning plates interacting with the positioning pins arranged so as to be adjustable in the print bar receptacles such that the print bar is centered and arrested at four position points in the drive and guidance units.

4. The device according to claim 3 wherein the first and the second positioning plates are provided with a respective depression in which the positioning pins arranged in the print bar receptacles engage upon lowering of the guidance units together with the print bar receptacles into the depressions of the first and second positioning plates.

5. The device according to claim 4 wherein:

the first positioning plate, which has a conical depression, is provided in the first drive and guidance unit; and the second positioning plate, which has a prismatic depression, is provided in the second drive and guidance unit.

6. The device according to claim 5 wherein the depressions have angled lateral surfaces.

7. The device according to claim 5 wherein a respective third positioning plate which respectively has a flat surface is provided in both drive and guidance units.

8. The device according to claim 4 wherein the positioning pins are round at a tip so that a play exists between the positioning pins and the depressions in the positioning plates at a beginning of an engagement of the positioning pins in the depressions before the arresting.

9. The device according to claim 1 wherein the guidance units respectively each have at least one arbor for each drive and guidance unit, said arbor respectively engaging in a receptacle bore provided in the print bar receptacles, a diameter of the respective receptacle bore being chosen to be greater than a diameter of the respective arbor in order to achieve a floating bearing of the print bar in the drive and guidance units, and an elastic unit that can be screwed onto the arbor being provided that exerts an elastic force on the print bar receptacle in a direction towards the guidance unit.

10. The device according to claim 3 wherein a play of the floating bearing of the print bar in the drive and guidance units is chosen to be less than an entrance diameter of a depression of the first positioning plate or less than an entrance width of a prismatic depression of the second positioning plate.

11. A method for positioning a print bar in a printing position in an inkjet printing apparatus, comprising the steps of:

inserting the print bar into first and second drive and guidance units each of which comprise guidance units and such that arbors of the guidance units engage in receptacle bores of the print bar receptacles of the print bar, wherein a diameter of the respective receptacle bore is chosen to be larger than a diameter of the respective arbor, and wherein respective elastic units are screwed into the respective arbors via the respective print bar receptacles so that an elastic force is exerted on the print bar receptacles in a direction towards the guidance units; and in a positioning of the print bar in the drive and guidance units in said printing position, lowering the guidance units until positioning pins provided such that they can be displaced in the print bar receptacles engage in positioning plates arranged in the drive and guidance units, wherein the print bar receptacles detach from the guidance units, and the positioning pins are positioned in the associated positioning plates due to a weight of the print bar and the elastic force of the elastic units and thereby center and arrest the print bar in the drive and guidance units.

12. A method for positioning at least one print bar in a printing position in an inkjet printing apparatus, comprising the steps of:

providing first and second drive and guidance units for the print bar, said drive and guidance units each respectively having an adjustable guidance unit and a first coupling unit;

providing the print bar with print bar receptacles with adjustable positioning pins for each of the drive and guidance units; and designing the guidance units of the drive and guidance units and the print bar receptacles of the print bar such that during inserting of the print bar into the drive and guidance units, the print bar receptacles of the print bar rest in a floating bearing on the guidance units of the drive and guidance units and are centered and arrested after displacement of the guidance units in the drive and guidance units such that the respective print bar is positioned in said printing position, the positioning pins engaging in the first coupling units.

* * * * *